US006960011B2

(12) United States Patent
Oswald et al.

(10) Patent No.: US 6,960,011 B2
(45) Date of Patent: Nov. 1, 2005

(54) VIBRATOR AND RELATED METHOD

(76) Inventors: Fred Oswald, 27 Forest Dr., Sands Point, NY (US) 11050; Robert Rhodes, 291 Carroll St., Clermont, FL (US) 34711

( * ) Notice: Subject to any disclaimer, the term of this patent is extended or adjusted under 35 U.S.C. 154(b) by 0 days.

(21) Appl. No.: 10/836,034

(22) Filed: Apr. 30, 2004

(65) Prior Publication Data

US 2004/0208080 A1 Oct. 21, 2004

Related U.S. Application Data

(62) Division of application No. 10/021,905, filed on Dec. 13, 2001, now abandoned.

(51) Int. Cl.[7] ..... B01F 11/00
(52) U.S. Cl. ..... 366/108; 366/122; 366/123; 264/69
(58) Field of Search ..... 366/108, 115, 117, 366/118, 120, 122, 128, 123; 56/340.1; 264/69

(56) References Cited

U.S. PATENT DOCUMENTS 1,770,154 A * 7/1930 Day ..... 264/69
1,927,075 A * 9/1933 Thomas ..... 366/122
1,970,740 A * 8/1934 Day ..... 366/108
2,015,217 A * 9/1935 Deniau ..... 366/122
2,040,666 A * 5/1936 Miller ..... 264/69
2,522,906 A * 9/1950 Smith ..... 366/108
3,551,967 A * 1/1971 Williams ..... 264/69
6,239,507 B1 * 5/2001 Douthit ..... 290/55

FOREIGN PATENT DOCUMENTS

JP 07048927 * 2/1995

OTHER PUBLICATIONS

Oztec Advertising Flyer, Published on or About Feb. 2001, 1 page.

* cited by examiner

*Primary Examiner*—Tony G. Soohoo
(74) *Attorney, Agent, or Firm*—Myron Amer P.C.

(57) ABSTRACT

The invention relates to the setting of poured concrete and the need to avoid air pockets and voids within the setting slurry. At least one reinforcing rod, and preferably a grid of rods, is embedded in the poured concrete. The setting slurry is vibrated by vibrating the rod or grid. A vibrator receives the protruding end of the rod and is vibrated to vibrate the rod.

32 Claims, 8 Drawing Sheets

VIBRATOR AND RELATED METHOD

This application is a divisional of application Ser. No. 10/021,905 filed on Dec. 13, 2001 abandoned claims the benefit thereof and incorporates the same by reference.

FIELD OF THE INVENTION

This invention relates to the construction industry and is particularly concerned with pouring, and setting of concrete using a vibrator to agitate a poured slurry of wet concrete.

BACKGROUND OF THE INVENTION

In the construction industry, it is frequently necessary to lay a large area of concrete. Such areas can include, for example, foundations for buildings, floors, driveways, sidewalks, ramps, etc.

Concrete exhibits characteristics of strength in compression but is poor in tension. To increase strength in tension, it is common practice to prepare a grid of reinforcing bars and then to pour concrete over and around the grid whereby the reinforcing bars improve the strength the poured concrete. After the wet concrete has been poured over and around the grid of reinforcing bars, it is common practice in the art to vibrate the concrete to remove air and voids from the poured mix. In this manner, when the concrete hardens, the slab will be more compact and undesirable pockets within the hardened concrete are avoided and the integrity of the concrete is not compromised.

The most common form of concrete vibrator comprises a metal cylinder within which a shaft carrying an eccentric weight is rotatable to cause the metal cylinder to vibrate. The cylinder is mounted on one end of a flexible drive which serves to rotate the shaft and hence vibrate the cylinder. When the vibrating cylinder is introduced into, and immersed in, the wet concrete mix or slurry, vibrations, which may be in the region of 10,000 per minute, agitate the slurry to extent sufficient to remove air and voids therefrom.

Concrete is a mixture of cement, sand, and stones. Lime is an ingredient in cement and water is mixed with the components of the mixture to activate the lime and form a mix or slurry. With the reinforcing bars immersed in and surrounded by this poured wet mix or slurry, there is a potential problem in that the reinforcing bars may rust. When a steel bar rusts, it expands, and the expansion of the bar within the dried concrete can cause the concrete to crack. To overcome this problem, it has been practice in the art to envelope the reinforcing bars in a plastic-like coating, most commonly an epoxy, which will protect the steel from wet liquid and hence avoid rusting and the subsequent detrimental consequences thereof. Even so, the placing of a rapidly vibrating vibrator within the slurry creates the risk that the vibrator will chip the plastic coating thereby exposing the encased steel to the wet slurry and the prevention of rusting is not eliminated.

SUMMARY OF THE INVENTION

The invention involves the creation of vibration in a slurry of poured concrete within which reinforcing bars are located. However, rather than inserting a conventional vibrator into the wet mix, vibrations are imparted to the slurry by vibrating the reinforcing rods themselves.

According to the present invention, there is provided, for vibrating a bar, a vibrator including a vibrator housing, means for vibrating said housing, and means associated with said housing for contacting said bar.

According to a further aspect of the invention, there is provided a vibrator including a vibrator unit, a housing coupled to said unit, and means within said housing for engaging a member to be vibrated whereby vibrations from said vibrator unit may be transmitted to said member.

According to a further aspect of the invention, there is provided a vibrator including a casing, vibration inducing means within said casing, a housing secured to said casing to be vibrated thereby and means within said housing for engaging and vibrating a member.

According to a further aspect of the invention, there is provided a vibrator including an elongated casing, a shaft extending longitudinally within said casing for rotation therein, an eccentric weight associated with said shaft for rotation thereby to create vibrations, a housing secured to said casing, and a plug secured within said housing and having at least one bore arranged to receive one end of a bar.

According to a further aspect of the invention, there is provided a vibrator including a casing, a rotatable eccentric within said casing, a housing secured to said casing, a plug secured within said housing, said plug having at least one bore extending at least partially therethrough and dimensioned to receive one end of a reinforcing bar whereby vibration created by rotation of said eccentric will be transmitted to said reinforcing bar.

According to a further aspect of the invention, there is provided a method of vibrating a member including the steps of placing a vibrator in contact with said member and vibrating said vibrator to vibrate said member.

According to a further aspect of the invention, there is provided a method of vibrating a bar including the steps of seating one end of said bar in a housing and vibrating said housing to impart vibrations said bar.

According to a further aspect of the invention, there is provided a method of setting concrete including the steps of providing at least one reinforcing bar, pouring wet concrete around said bar, at least partially to embed said bar, seating a protruding end of said bar in a vibrator housing, and vibrating said vibrator housing to impart vibrations to said at least partially embedded bar.

INTRODUCTION TO THE DRAWINGS

Preferred embodiments of the invention will now be described with reference to the accompanying drawings, in which.

Figure 1:
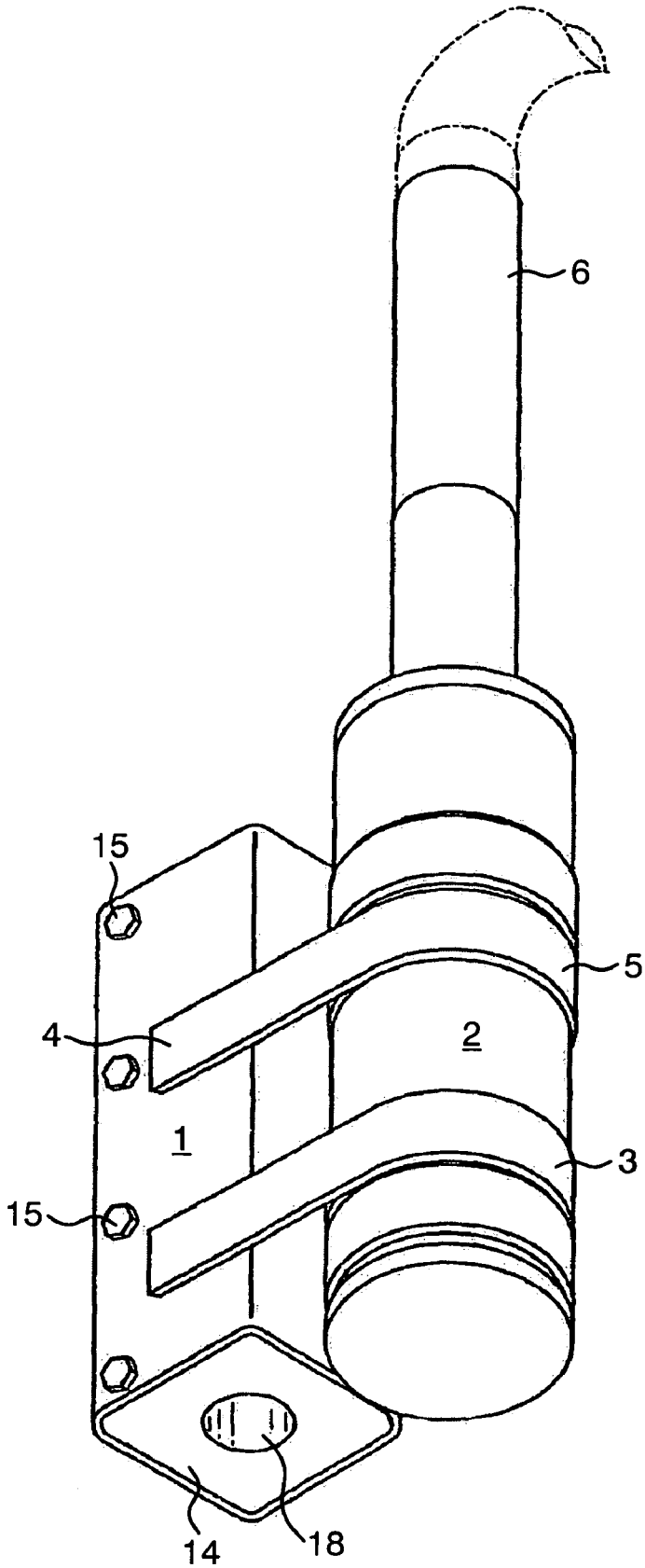
FIG. 1 is a perspective view of one embodiment of the invention.
Figure 2:
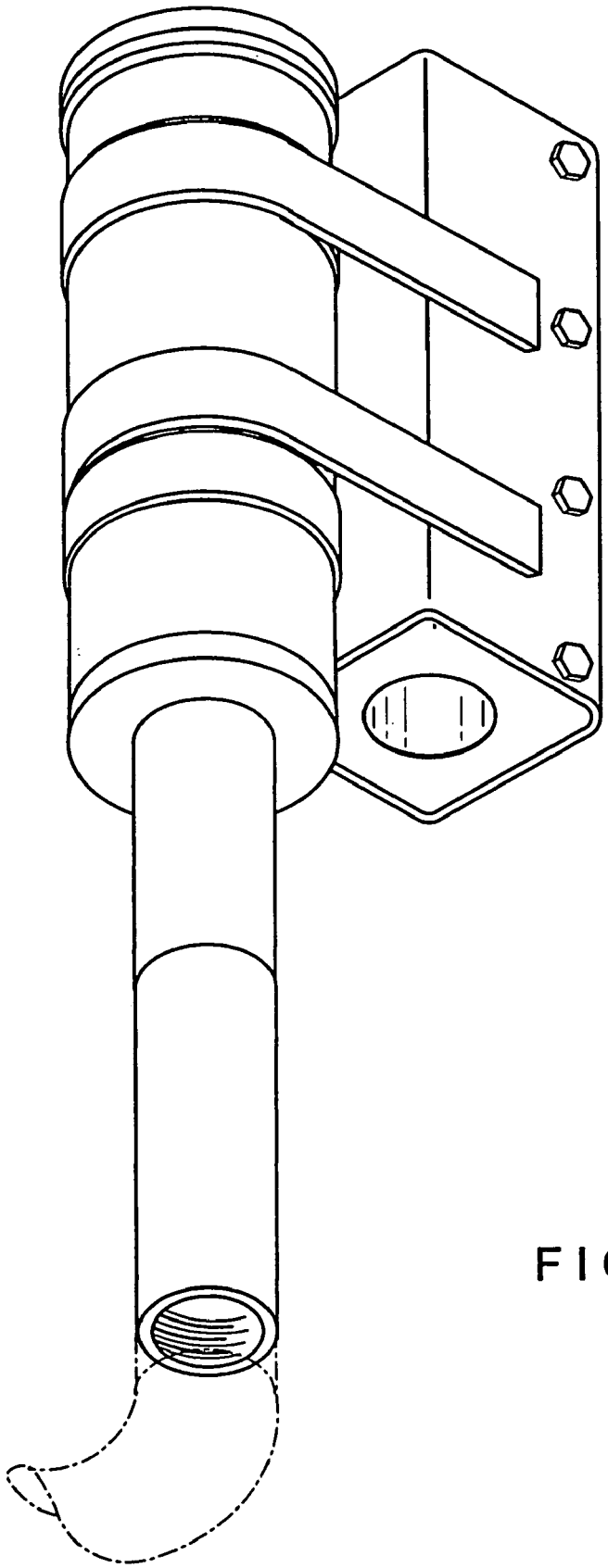
FIG. 2 is perspective view of the embodiment of FIG. 1 shown in an inverted position.
Figure 9:
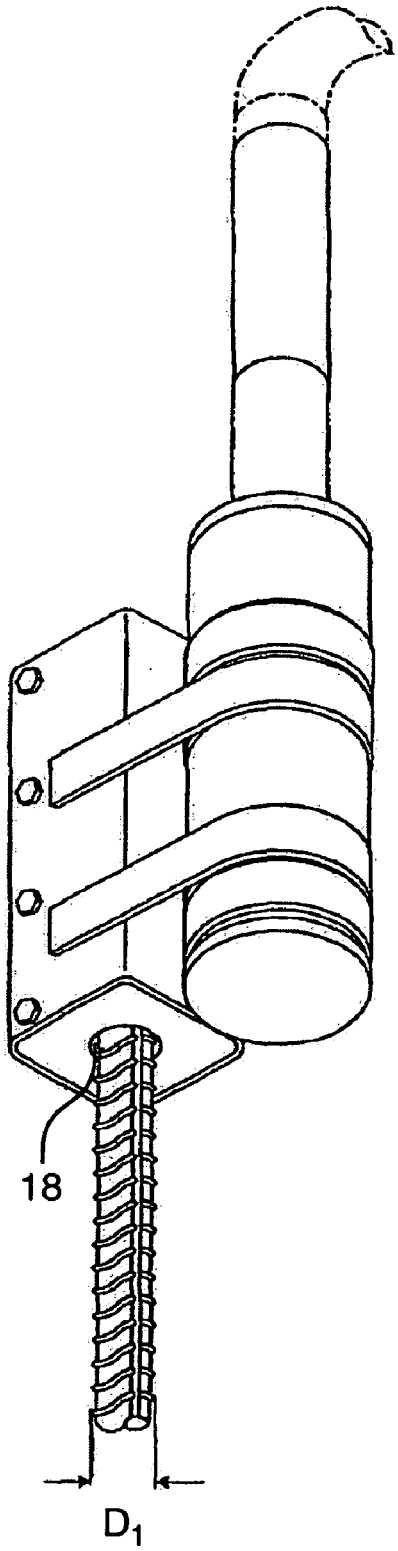
FIG. 9 shows the article in use in the position shown in FIG. 1.
Figure 10:
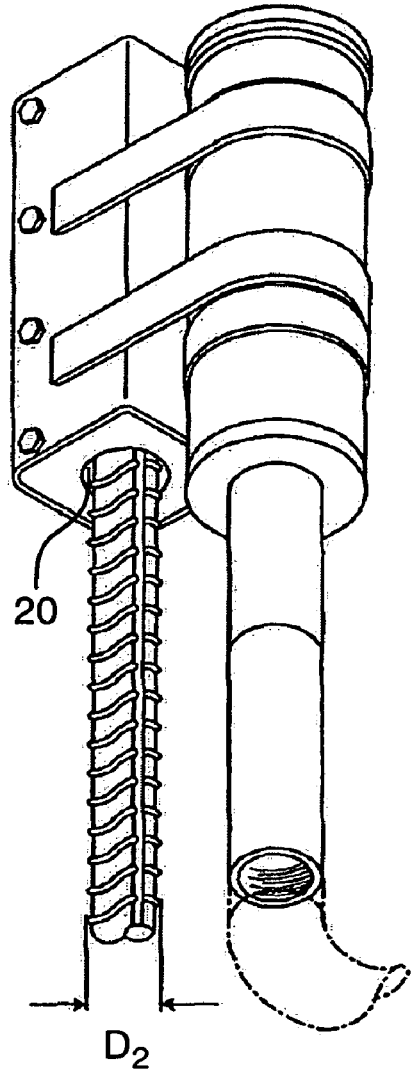
Figure 11:
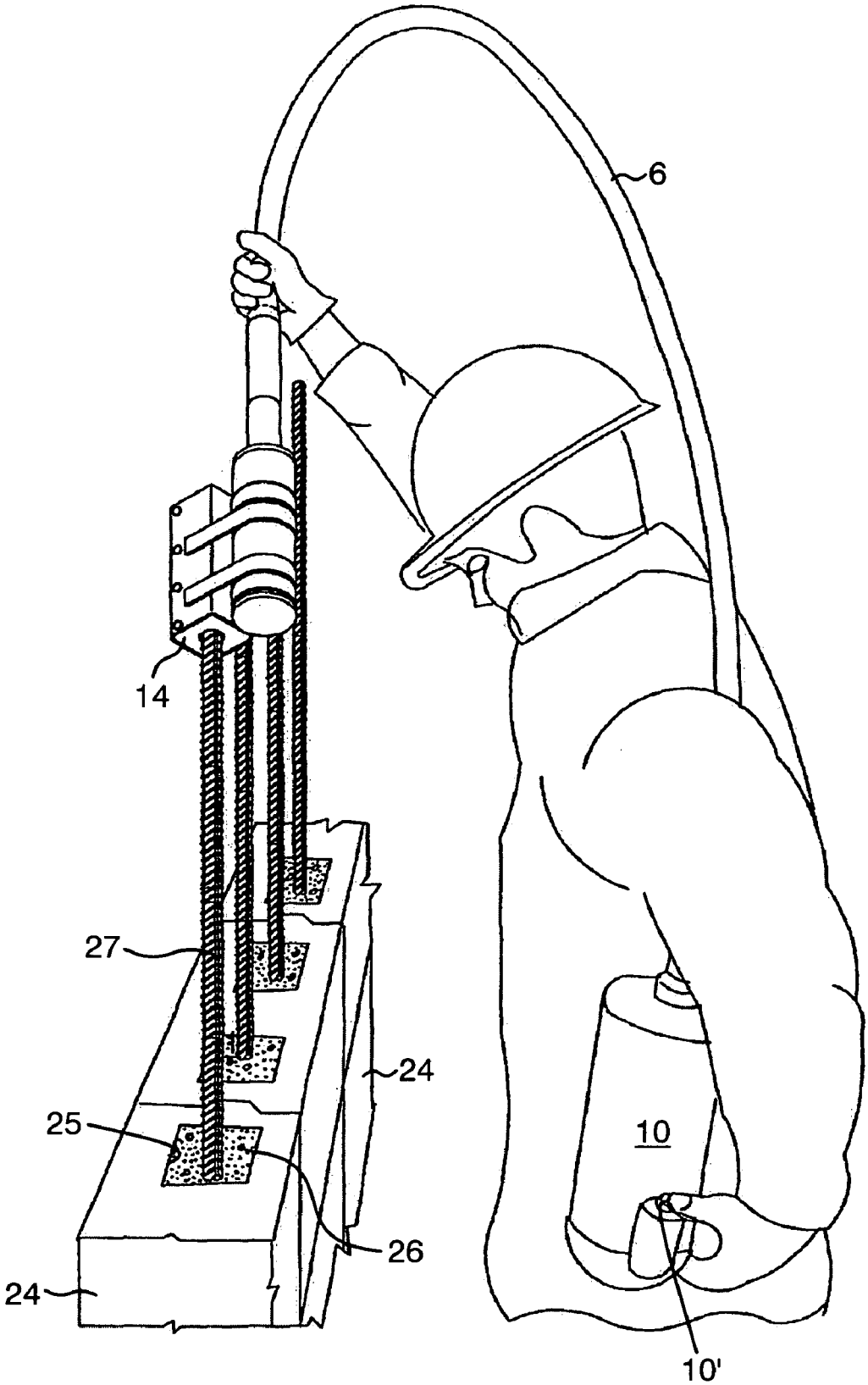
Figure 12:
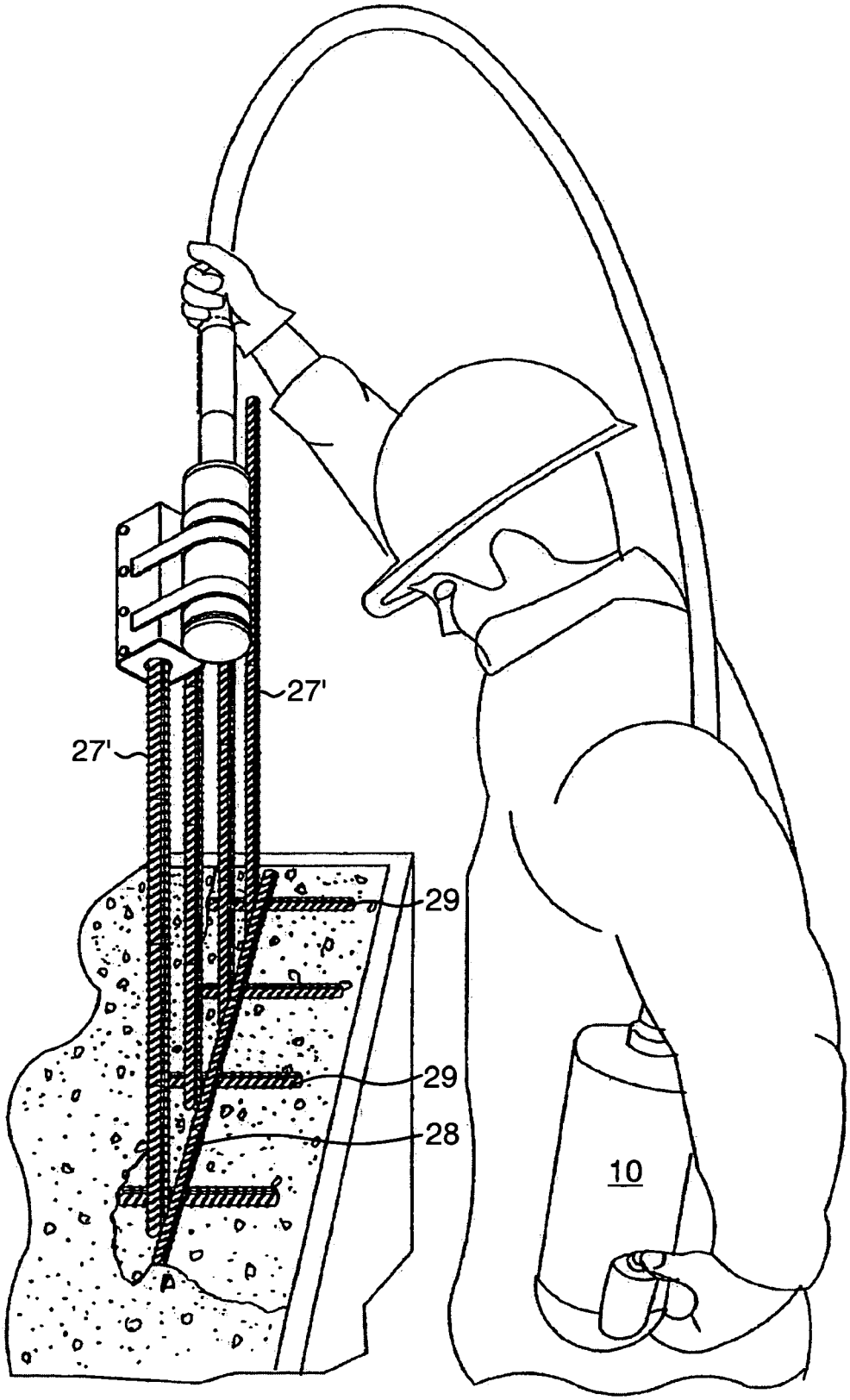
Figure 13:
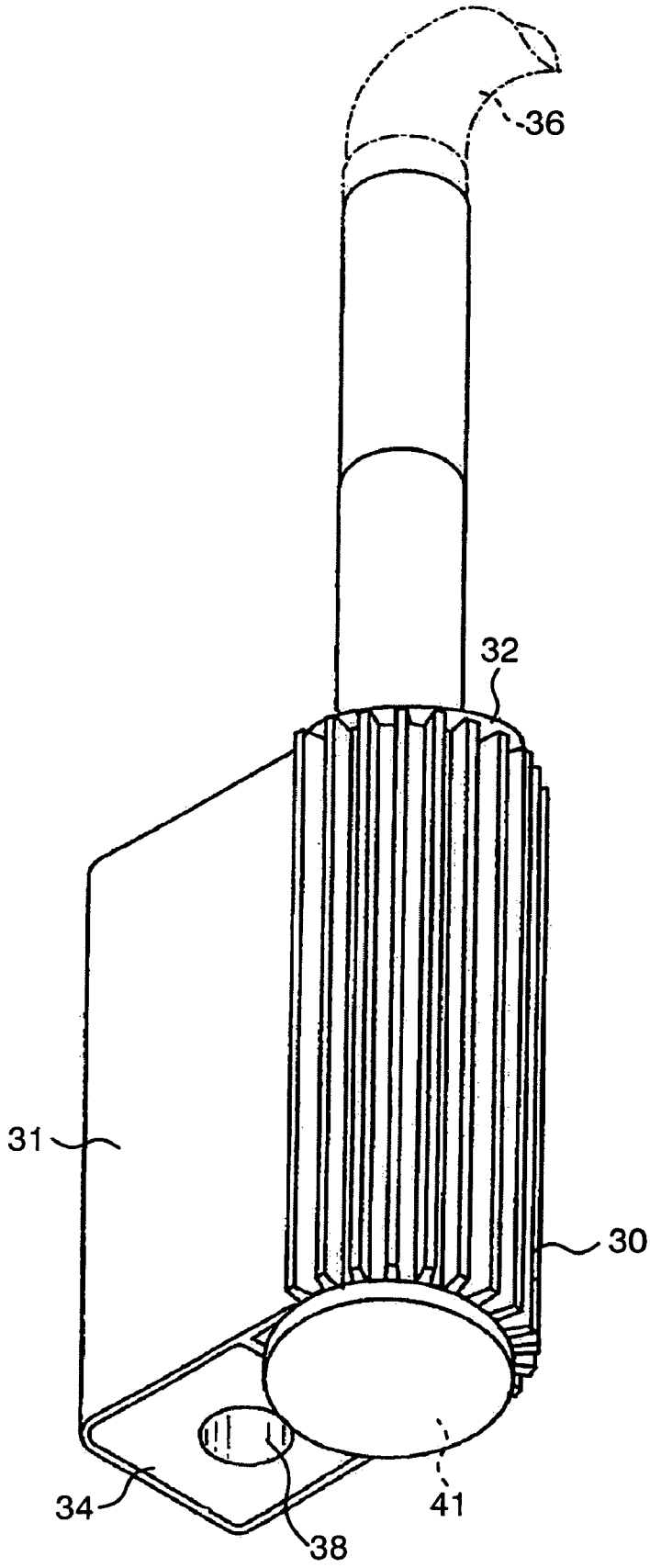

FIG. 10 shown the article in use in the position shown in FIG. 2;

FIG. 11 is an illustrative view showing, in greater detail, the mode of operation show in FIG. 9;

FIG. 12 is a view similar to FIG. 11 but showing use with a different structure; and, FIG. 13 is a view similar to FIG. 1 but showing a modified embodiments.

DESCRIPTION OF PREFERRED EMBODIMENT

Referring now to the drawings, the vibrator shown in FIG. 1 comprises a housing 1 rigidly attached to a casing by metallic straps 3 to form an integral unit. In the embodiment shown in FIG. 1, the casing is a cylinder 2 and the straps 3 are U-shaped staple-like bands having their free ends welded or otherwise firmly secured to the housing 1 and their rounded portion extending around the cylinder 2 and similarly welded or otherwise secured thereto. In this manner, the cylinder 2, while rigidly secured to the housing 1 can be spaced therefrom, although, as will be described with particular reference to FIG. 13, there is no reason why the cylinder 2 could not abut the housing 1.

Alternatively, although not shown in the drawings, the U-shaped straps could be replaced by strips, each strip having one end secured to the housing 1 and the other end to the vibrator cylinder 2. Again, securing can be effected by welding, by bolting, or by any other appropriate means.

Figure 4:
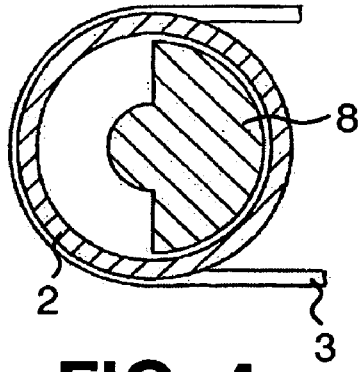
FIG. 4 is a section along the line 4—4 of FIG. 3.
Figure 5:
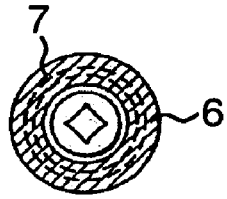
FIG. 5 is a section along the line 5—5 of FIG. 3.

Vibration is imparted to the housing 1 by rotating a shaft 7 which extends longitudinally and concentrically within the cylinder 2 and carries an eccentric weight 8 which can either be keyed on the shaft 7 for rotation therewith or, as best shown in FIG. 4, can be a unitary casting. Such a casting is attached, for example, by splines 9 to the shaft 7 for rotation thereby. Whether an integral casting or a separate component, the rotation of the eccentric weight within the cylinder will create vibrations which are imparted to the housing 1 by the connecting straps 3.

In operation, the shaft 7 is connected to a motor 10 by a flexible drive 6 and the motor 10 may be portable as shown in FIGS. 11 and 12 or may be a free-standing power unit capable of driving a plurality of vibrators, each connected to the power unit by its own flexible drive.

The vibrator cylinder is a self-contained unit closed by an end cap 11. Bearings 12 are located within the cylinder 2 and support the shaft 7 to permit free turning of the eccentric weight. A seal 13 serves not only to prevent egress of lubricating fluid from the bearings but also ingress of contaminants such as dust, grit, or like particles which would be deleterious to the smooth running of the bearings.

Figure 6:
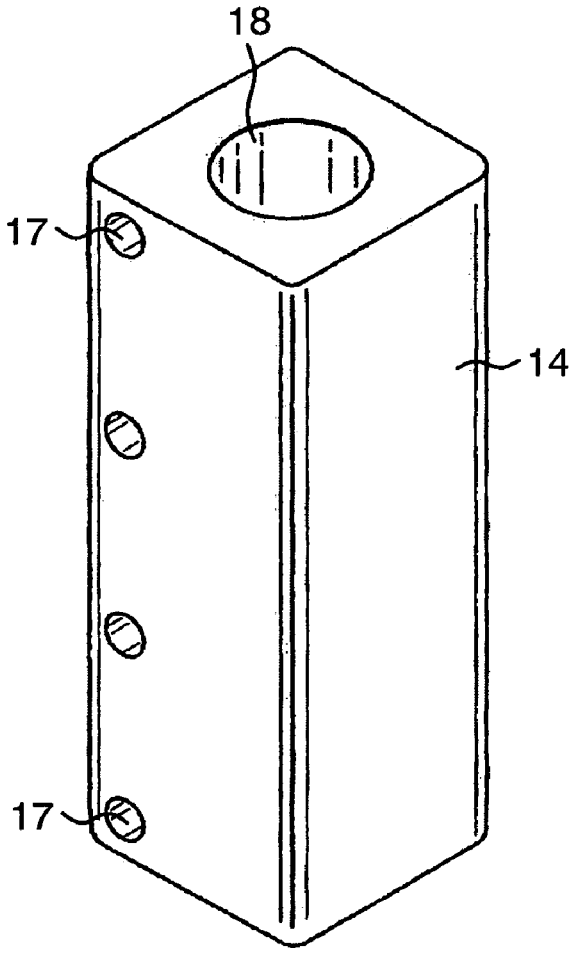
FIG. 6 is a perspective view of a component of the embodiment shown in FIG. 1.
Figure 8:
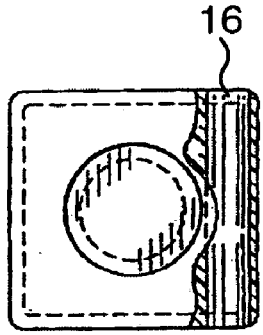
FIG. 8 is a top plan view of the component shown in FIG. 6.

The housing 1 is shown in the form of rectangular hollow tubular casting of metal which accommodates a plug 14 of firm, but resilient, material. A suitable composition is neoprene which, as will be explained hereinafter, is capable of accommodating a reinforcing bar and imparting vibration thereto while eliminating chatter. The plug 14 is snugly accommodated in the metal housing and is firmly retained in place by bolts 15 or other pin-like retaining elements which extend through holes 16 in the metallic casting and through registering bores 17 in the plug 14. As shown most clearly in FIGS. 6 and 8, the bores 17 extend transversely through the plug 14 and are not to be confused with a longitudinal bore 18 which extends concentrically at least part way through the plug 14.

Figure 3:
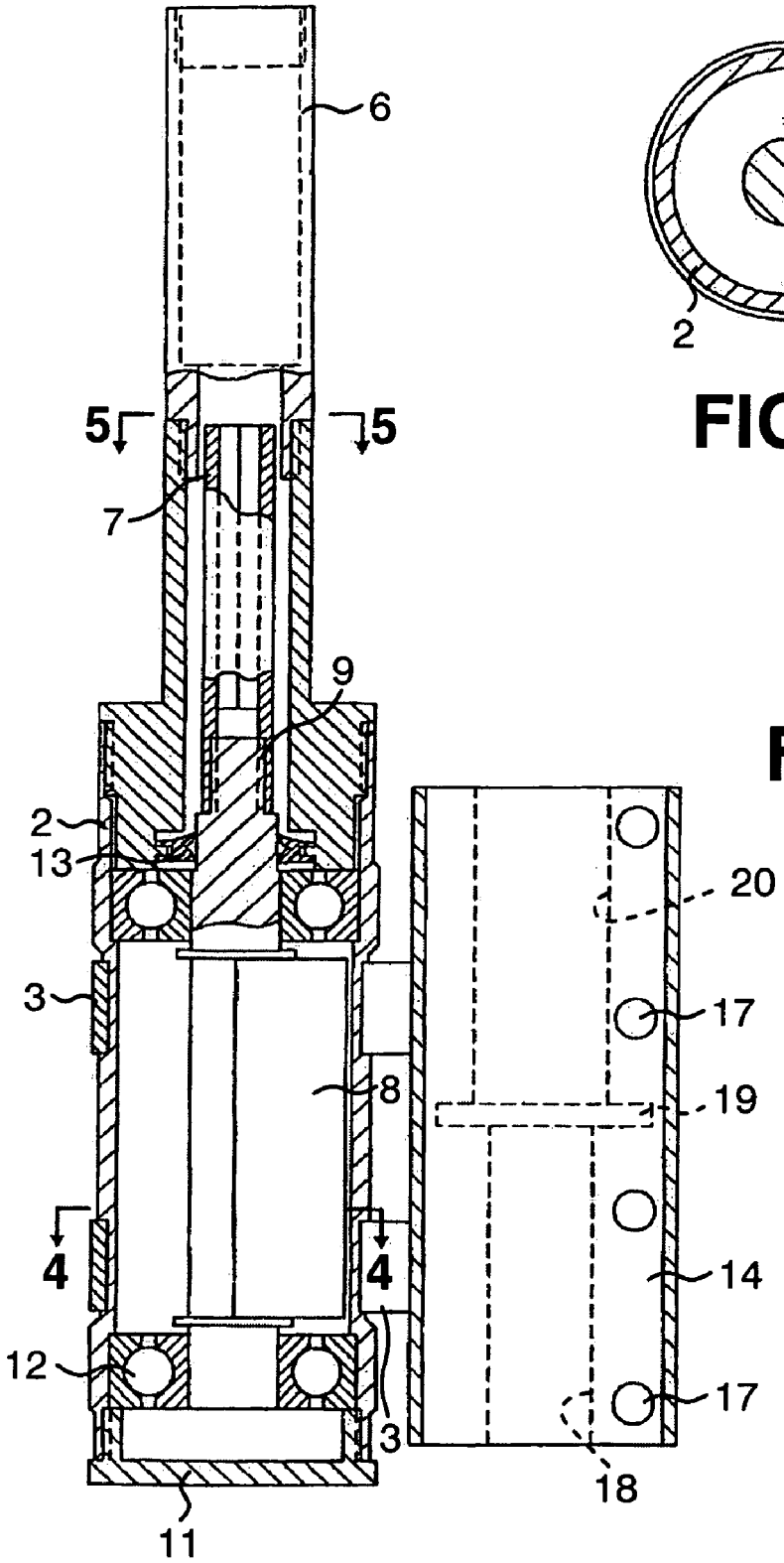
FIG. 3 is a vertical section through the embodiment of FIGS. 1 and 2.
Figure 7:
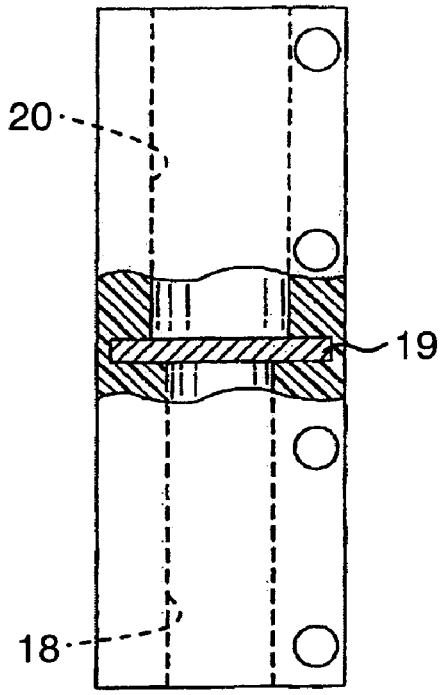
FIG. 7 is a vertical section through the component of FIG. 6.

In one embodiment (not shown) the bore is a blind bore having walls and a bottom dimensioned comfortably to accommodate one end of a reinforcing bar. However, in the preferred embodiment, the bore extends completely through the plug 14 but is interrupted by a plate 19 embedded in the plug 14 which provides a common bottom to two concentric mutually opposed bores 18 and 20. As shown in FIGS. 3 and 7 of the drawings, the bores 18 and 20, while concentric, may be of differing diameter and thereby capable of accommodating differently dimensioned reinforcing bars. FIGS. 9 and 10 show a reinforcing bar having a diameter D1 accommodated in the bore 18 and a larger reinforcing bar having a diameter $D_2$ accommodated in the bore 20.

Additionally, and in order to accommodate rods of further differing diameter, a second plug having longitudinal bore diameters different from those in the plug 14 can be substituted for the plug 14. To accomplish this, it is necessary only for the second plug to have external dimensions the same or very similar to those of the plug 14 and also to having similarly aligned transverse bores similar to the bores 17 to register with the holes 16 and received the retaining bolts 15.

FIGS. 1 and 2 of the drawings show alternative orientations of the vibrator of the invention to seat on the top of an upwardly projecting reinforcing rod as shown, for example, in FIG. 11 of the drawings. However, the flexibility of the drive 6 and the extent to which the vibrator, by virtue of its size and weight, are such that the hand-held vibrator can be both oriented and driven in any desired direction, making it possible to engage and vibrate reinforcing rods which protrude in any direction out of a bed or swath of poured concrete.

Operation of the above-described vibrator will now be described more particularly with reference to FIGS. 11 and 12 of the drawings. The need to settle poured concrete and the utilization of reinforcing bars has been described in the opening paragraphs of this specification, and FIGS. 11 and 12 show two alternative constructions with reinforcing bars extending upwardly and outwardly of a bed of poured concrete.

In FIG. 11 a plurality of blocks 24 are stacked with each block having a cell or channel 25 extending therethrough with the channels of superposed blocks in alignment. Concrete 26 is poured into the channels and reinforcing rods or bars 27 extend downwardly through the channels of the superposed blocks and are embedded in the poured concrete. The vibrator of the invention is used to vibrate the reinforcing bars to agitate the poured concrete in order to remove air therefore and enable the concrete to settle and set in pillar-like columns and thereby impart rigidity to the assembled stacked blocks to form a reinforced wall.

To this end, the construction worker will place the housing 1 over a reinforcing bar 27 and will seat the upper end of that bar in the bore 18 in the plug 14 within the housing. The construction worker will then activate the motor 10, for example by a manual switch 10', rapidly to rotate the shaft 7 and, by means of the eccentric weight 8, impart vibrations to the reinforcing rod through the intermediary of the plug 14 within the housing 1. The vibrations imparted to the bar 27 are transmitted to the concrete 26 surrounding the bar to enhance both de-aeration and settlement of the concrete. If reinforcing bars of differing diameters extend upwardly out of the stacked blocks shown in FIG. 11, then the construction worker can simply invert the vibrator to accommodate a larger reinforcing bar in the larger bore 20.

FIG. 12 illustrates similar use of the vibrator to vibrate a reinforcing bar, but in that Figure a larger area of concrete is poured, and a grid of laterally extending reinforcing bars 28, 29 is embedded within the poured concrete. With the appreciation that vibration of the grid 28, 29 will enhance the strength of the poured concrete, a plurality of reinforcing bars 27' extend upwardly out of the poured concrete and are located so that the lower ends of the bars 27' within the poured concrete abut the grid. With such a construction, vibration of the upstanding bars 27' in the manner described in the foregoing paragraphs with reference to FIG. 11 will transmit vibrations to the grid 28, 29 to cause the desired agitation in the setting concrete.

When the desired agitation has been accomplished and voids within the poured slurry eliminated or very substantially diminished, disassembly is effected merely by removing the vibrator from the protruding end of the reinforcing bar. This avoids a problem inherent in vibrators of the type which are themselves immersed in the wet slurry. Such problem arises when a rapidly vibrating vibrator is removed from a wet slurry and the emergence of the vibrator from the surface of the slurry causes wet portions of the surface to fly rapidly upward the outward creating severe splatter.

In the embodiments described hereinabove and with particular reference to FIGS. 1 and 3 of the drawings, the housing 1 and vibrator cylinder 2 are separate components which are rigidly connected to one another by means welded metallic straps. The embodiment of the invention shown in FIG. 13 of the drawings comprises a one-piece unitary housing in which the plug accommodating housing and the vibrator cylinder are cast as a single unit.

With one exception, the remaining features of construction are essentially the same as in the embodiment described with reference to FIG. 1 et seq and, for example, the aligned bores 17 and plug retaining bolts 15 are omitted for clarity. The exception is the provision of radially extending fins 30 around the cylindrical vibrator portion of the unit. These fins 30 are provided to dissipate heat generated both in the bearings upon rotation of the shaft and eccentric weight (not shown) and by the vibrations themselves caused by said rotation. As rotation and vibration can be of the order of 8000 to 12000 rpm, the heat generated can be substantial making it important to dissipate the heat.

Both construction and operation of the embodiment shown in FIG. 13 is otherwise the same as that described with reference to the previous drawings and the embodiment thus includes a housing 31, a plug 34 accommodated within the housing and presenting a longitudinal blind bore 38 to receive and accommodate an upwardly extending reinforcing bar. The fins 30 extend radially outwardly from the cylindrical vibrator portion 32 which is closed at its lower end by a cap 41 and accommodates a rotatable shaft and eccentric weight (not shown) coupled by a flexible drive 36 to a remote motor (not shown).

In the previously described preferred embodiments, the vibrator unit is "coupled" to a reinforcing bar by seating a free end of the reinforcing bar within a portion of the vibrator. Whilst this is a preferred arrangement, it will be appreciated that vibration of a protruding reinforcing bar to de-aerate and settle poured concrete which has not yet set and from which the bar protrudes could be effected by providing the vibrator with an external quick-release clamp-type mechanism design to grasp and hold the reinforcing bar while vibrations are transmitted thereto.

What is claimed is:

1. A vibrator for vibrating a bar, including a vibrator housing, means for vibrating said housing, and means associated with said housing for contacting said bar, said vibrator housing being adapted to seat over an end of the bar, a bore extending at least part way through said housing and is open to receive an end of the bar, and a plug is retained within the housing and wherein the bore is provided in the plug.

2. A vibrator as claimed in claim 1, wherein a first bore having a first diameter is provided in the plug, and a second bore having a second diameter is also provided in the plug.

3. A vibrator as claimed in claim 2, wherein the first and second bores are aligned and open out of the plug in opposite directions.

4. A vibrator as claimed in claim 3, wherein the aligned, oppositely directed bores are separated by a member embedded in the plug, said member providing the bottom of each bore.

5. A vibrator as claimed in claim 2, wherein the first and second bores are blind bores.

6. A vibrator as claimed in claim 1, wherein the plug is interchangeably secured within the housing.

7. A vibrator as claimed in claim 6, wherein the plug is secured within the housing by elements extending through respective openings in the housing and into aligned bores in the plug.

8. A vibrator as claimed in claim 7, wherein the securing elements are bolts.

9. A vibrator including a vibrator unit, a housing coupled to said unit, and means within said housing for engaging a member to be vibrated whereby vibrations from said vibrator unit may be transmitted to said member, and a bore extends at least part way through said housing and is open to receive an end of the member, and wherein the member is a reinforcing bar and wherein a plug is retained within the housing and the bore is provided in said plug.

10. A vibrator including an elongated casing, a shaft extending longitudinally within said casing for rotation therein, an eccentric weight associated with said shaft for rotation thereby to create vibrations, a housing secured to said casing, and a plug secured within said housing and having at least one bore arranged to receive one end of a bar.

11. A vibrator as claimed in claim 10, wherein a first bore having a first diameter is provided in the plug, and a second bore having a second diameter is also provided in the plug, said first and second bores being aligned and opening out of the plug in opposite directions.

12. A vibrator as claimed in claim 10, wherein the aligned, oppositely directed bores are separated by a member embedded in the plug, said member providing the bottom of each bore.

13. A vibrator as claimed in claim 10, wherein the plug is interchangeably secured within the housing.

14. A vibrator as claimed in claim 13, wherein the plug is secured within the housing by elements extending through respective openings in the housing and into aligned bores in the plug.

15. A vibrator as claimed in claim 10, wherein the housing is secured to the casing by at least one strap element of staple-like configuration with the free ends of said staple secured to the housing and the body of the staple extending around and secured to the vibrator casing.

16. A vibrator as claimed in claim 10, wherein the housing and the casing are a unitary member.

17. A vibrator as claimed in claim 16, wherein cooling fins extend radially outwardly from the vibrator casing.

18. A vibrator as claimed in claim 10, wherein the shaft and the eccentric weight are a unitary casing.

19. A vibrator as claimed in claim 10, wherein the eccentric weight is secured on the shaft.

20. A vibrator as claimed in claim 10, wherein a seal surrounds said rotatable shaft to prevent egress of lubricating liquid from within the vibrator casing and ingress of contaminants.

21. A vibrator including a casing, a rotatable eccentric within said casing, a housing secured to said casing, a plug secured within said housing, said plug having at least one bore extending at least partially therethrough and dimensioned to receive one end of a reinforcing bar whereby vibration created by rotation of said eccentric will be transmitted to said reinforcing bar.

22. A vibrator as claimed in claim 21, wherein a first bore having a first diameter is provided in the plug, and a second bore having a second diameter is also provided in the plug, said first and second bores being aligned and opening out of the plug in opposite directions.

23. A vibrator as claimed in claim 22, wherein the aligned, oppositely directed bores are separated by a member embedded in the plug, said member providing the bottom of each bore.

24. A vibrator as claimed in claim 21, wherein the plug is interchangeably secured within the housing.

25. A vibrator as claimed in claim 24, wherein the plug is secured within the housing by elements extending through respective openings in the housing and into aligned bores in the plug.

26. A vibrator as claimed in claim 21, wherein the housing is secured to the vibrator unit by at least one strap element of staple-like configuration with the free ends of said staple secured to the housing and the body of the staple extending around and secured to the vibrator casing.

27. A vibrator as claimed in claim 21, wherein the housing and the vibrator casing are a unitary member.

28. A vibrator as claimed in claim 27, wherein cooling fins extend radially outwardly from the vibrator casing.

29. A vibrator as claimed in claim 21, wherein a shaft extends longitudinally within the casing, said shaft being rotatable by an external source, and wherein the eccentric is a weight provided on said shaft.

30. A vibrator as claimed in claim 29, wherein the shaft and the eccentric weight are a unitary casting.

31. A vibrator as claimed in claim 29, wherein the eccentric weight is secured on the shaft.

32. A vibrator as claimed in claim 29, wherein a seal surrounds said rotatable shaft to prevent egress of lubricating liquid from within the vibrator casing and ingress of contaminants.

* * * * *